United States Patent [19]

Mayer

[11] Patent Number: 4,841,259

[45] Date of Patent: Jun. 20, 1989

[54] WAVE PROPAGATION STRUCTURES FOR ELIMINATING VOLTAGE SURGES AND ABSORBING TRANSIENTS

[76] Inventor: Ferdy Mayer, 92-98 boulevard Victor-Hugo, 92115 Clichy, France

[21] Appl. No.: 97,014

[22] Filed: Sep. 16, 1987

[30] Foreign Application Priority Data

Sep. 13, 1986 [FR] France ..... 86 13093

[51] Int. Cl.[4] ..... H01P 1/22; H01P 3/06; H01P 3/08

[52] U.S. Cl. ..... 333/17.2; 333/81 A; 333/245; 333/246

[58] Field of Search ..... 333/17 L, 81 R, 167, 333/174, 24.2, 12, 245–247, 181 R, 81 A, 81 B, 250, 202, 204, 205, 206, 207; 455/217; 357/7, 10, 12; 361/117–119, 126, 127

[56] References Cited

U.S. PATENT DOCUMENTS

| | | | |
|---|---|---|---|
| 4,344,047 | 8/1982 | Dixon, Jr. | 333/247 X |
| 4,388,632 | 6/1983 | Richardson | 357/15 |
| 4,495,482 | 1/1985 | Philipp | 357/10 X |
| 4,571,559 | 2/1986 | Henry et al. | 333/17 L |
| 4,642,584 | 2/1987 | Funck et al. | 333/262 |

*Primary Examiner*—Marvin L. Nussbaum
*Attorney, Agent, or Firm*—Sughrue, Mion, Zinn, Macpeak and Seas

[57] ABSTRACT

A four-pole or three-pole structure adapted to propagate an electromagnetic wave, such as an electrical line or cable or electronic component, comprises a lossy non-linear dielectric material distributed in a wave propagation direction. This material has a non-linear conduction characteristic whereby it is substantially non-conductive at any rated applied voltage of the structure and substantially conductive at any abnormally high applied voltage. It consists of a polycrystaline material comprising thin interstitial layers procuring a tunneling or Schottky type effect in response to a high electric field resulting from such abnormally high applied voltages. It absorbs both voltage surges (varistor effect in the time domain) and high-speed transients (lowpass filter effect in the frequency domain). The structure can be used to provide protection against lightning strikes, nuclear electromagnetic pulses, electrostatic discharges and radio-frequency interference in general.

22 Claims, 1 Drawing Sheet

FIG. 1
PRIOR ART
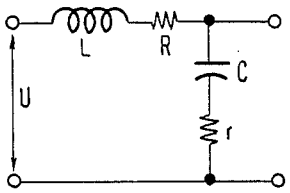
FIG. 2
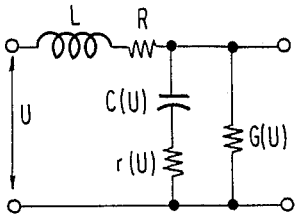
FIG. 3
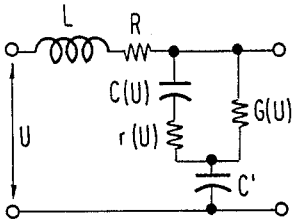
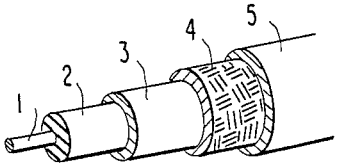
FIG. 4
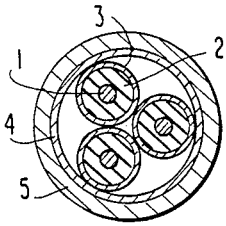
FIG. 5
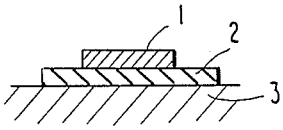
FIG. 6
FIG. 7
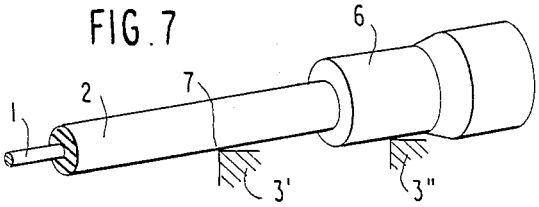
FIG. 8
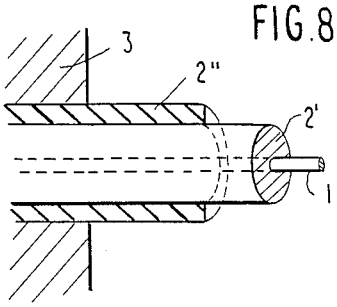
FIG. 9
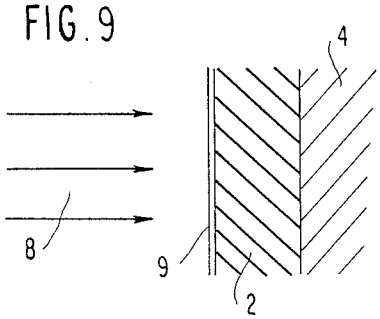
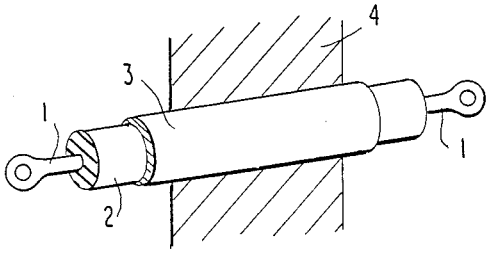
FIG. 10

WAVE PROPAGATION STRUCTURES FOR ELIMINATING VOLTAGE SURGES AND ABSORBING TRANSIENTS

BACKGROUND OF THE INVENTION

1. Field of the invention

The present invention concerns wave propagation structures for eliminating voltage surges and absorbing transients.

2. Description of the prior art

Electronic components exhibiting non-linear electrical behavior are currently well-known: thus silicon carbide (SiC) surge arrestors and zinc oxide (ZnO) resistors are routinely used to absorb unwanted voltage surges on high-voltage lines and in low-voltage electrical circuits and electronic circuits.

The electrical characteristic of a component of this kind is approximately defined by an equation of the form $I=k.U^n$ in which I is the current passing through it at an applied voltage U, n is the non-linearity coefficient representing the "slope" of the non-linearity (typically varying between 3 and 10 for an SiC resistor and between 20 and 70 for a ZnO resistor) and k is a constant defining the range of conductivity obtained.

In practice it is important to be able to obtain such characteristics not only with solid materials (sintered SiC and ZnO), but also with composite materials of a thermoplastic or thermo-hardening nature based on plastics materials, polymers, etc, in order to facilitate the fabrication by low-temperature techniques (compression molding, injection molding, extrusion, rolling, etc) of continuous or mass-produced parts, or when some degree of flexibility is required, as in applications to electrical wires and cables.

Such composite materials have been described in the literature, using SiC (French Pat. Nos. 1 260 453 and 1 363 222), ZnO (French Pat. No. 2 547 451) and various other metal oxides (U.S. Pat. No. 1,246,829). The coefficients of non-linearity obtained are in the range from 3 through 5. More recently, a company called Chomerics has marketed a flexible composite material based on silicon carbide and titanium ("CHOTRAP") with a coefficient of non-linearity in the order of 7 over a current range comprising 3 to 4 decades.

Applications of the composite materials described have been essentially limited to the production of sleeves for terminating medium and high-voltage insulated cables. A low current created by the equipotentials of the electric field produces a more favorable distribution of the field gradient, preventing breakdown at the terminations (see French Pat. Nos. 1 194 221, 1 260 453 and 1 363 222 and French patent application 2 423 036).

We are concerned here essentially with a "localized" layer in which there is no propagation effect, leading to a continuous low current defining the new and evenly distributed equipotentials.

It is an object of this document to disclose wave propagation structures (as opposed to a non-linear two-pole component) in which the non-linear medium is incorporated over the entire length of the propagation direction of an electromagnetic wave (characterizing the overvoltage disturbance) as a dielectric material.

In other words, the non-linear medium is operative in the distributed electrical elements of the structure.

Another object of this document is to disclose a structure of this kind which because of its distribution is free of stray effects (stray inductance, stray capacitance) characterizing two-pole structured components.

Another object of this document is to disclose a structure of this kind in which the non-linear medium is not operative when the applied electrical voltage is normal: in other words, this dielectric material functions normally as a conventional insulator. Only in the event of unwanted voltage surges appearing does this dielectric material conduct to "short-circuit" voltage surges either to ground or to another conductor.

A further object of this document is to disclose a structure of this kind in which the dielectric constant and the dielectic losses of the non-linear dielectric material are proportional to the applied voltage. In particular the (lossy) distributed capacitance increases to a significant degree, introducing a lowpass filter effect (RC network) and a change in the characteristic impedance $\sqrt{L/C}$ of the structure, and the corresponding reflections of the electromagnetic waves.

Another object of this document is to disclose a structure of this kind in which such non-linear effects are obtained with a dielectric and magnetic composite material, that is to say whereby the characteristics as defined hereinabove are complemented by magnetic effects with magnetic losses as described, for example, in French patent application No. 78 33385.

A final object of this document is to disclose a structure of this kind in which the voltage surge suppression effect (in the time domain) is combined with a filter effect by virtue of dielectric and/or magnetic absorption and reflection (in the frequency domain).

A structure of this kind thus functions simultaneously as a distributed voltage peak limiter and as a distributed lowpass filter (to the degree that losses increase with the frequency).

The practical benefit of the invention resides in the concept of distributed voltage surge suppression making it possible to distribute the dissipated power (voltage surges conducted to ground or to another conductor) and to eliminate the disadvantages of conventional non-linear (two-pole) components, such as inadequate response to high-speed transients.

Finally, the distribution of the non-linear effects in cable type structures introduces the new concept of integrating protection functions into the power or information transfer electrical connections, that is to say into the elements where these voltage surges and transients are generated and transmitted.

There are obvious benefits with regard to the protection of power distribution type links or signal and information distribution links against lightning strikes, against electromagnetic pulses due to nuclear explosions, against electrostatic discharges, and against voltage surges generated in the ignition distribution system of an automobile with breakdown of inductive loads.

SUMMARY OF THE INVENTION

The present invention consists in a structure adapted to propagate an electromagnetic wave and comprising a dielectric material distributed in a wave propagation direction, through which said wave passes, which exhibits non-linear conductivity whereby it is substantially non-conductive at any rated applied voltage of the structure and substantially conductive at any abnormally high applied voltage, and which consists of a polycrystaline material comprising thin interstitial layers procuring a tunneling or Schottky type effect in response to a high electric field resulting from such abnormally high applied voltages.

The invention will now be described in more detail by means of a number of examples and with reference to the appended drawings.

BRIEF DESCRIPTION OF THE DRAWINGS

FIG. 1 is a diagram showing the well-known and conventional four-pole (or three-pole) wave propagation structure with its distributed parameters:

L represents the distributed serial inductance, constituting the "internal self-inductance" due to the conductor and the "external self-inductance" due to the possible presence of a magnetic medium surrounding the conductor;

R represents the losses associated with the series inductance L, due to the conductor skin effect, for example, and where appropriate the magnetic losses $tg\delta_m = R/L\omega$;

C represents the shunt capacitance due to the dielectric material separating the "hot" conductor from ground (or another conductor);

r represents the series equivalent resistance of the dielectric losses, or the dielectric loss angle $tg\delta_e = r/C\omega$.

The dielectic used in accordance with the invention is a non-linear composite material, which is to say that it behaves substantially as an insulator at normal voltages as applied to the four-pole (or three-pole) device, but becomes substantially conductive when voltage surges appear at the terminals of the four-pole (or three-pole) device.

FIG. 2 shows the distributed elementary schematic of the structure in accordance with the invention into which a variable conductivity G(U) is introduced whose conduction increases with the applied voltage U and in which C(U) and r(U) define the permitivity and the dielectric losses which are proportional to the voltage U.

FIG. 3 shows the distributed elementary schematic of another structure in accordance with the invention in which a conventional insulator (that is to say one which is not voltage-dependent) is placed between the non-linear dielectric and ground (or the other conductor), introducing a capacitance C' which is assumed to be without losses.

FIG. 4 shows the application of the principle of the invention to a coaxial structure (such as a line component, a cable, etc) in which the non-linear dielectric is disposed between the "hot" conductor and an outer sheath or braid.

FIG. 5 shows the application of the principle of the invention to a multiconductor cable protected against common mode and symmetrical mode voltage surges.

FIG. 6 shows the application of the principle of the invention to a flat line component or a multi-conductor ribbon cable.

FIG. 7 shows the application of the principle of the invention to an insulated medium or high-voltage cable comprising a discontinuity in one of the electrodes.

FIG. 8 shows the application of the principle of the invention to a medium or high-voltage cable protected by distribution of the electrical field gradient in combination with a lowpass filter function.

FIG. 9 shows the application of the principle of the invention to a free wave propagation situation (plane wave, guided or unguided).

FIG. 10 shows the application of the principle of the invention to a four-pole (or three-pole) capacitor.

DESCRIPTION OF THE PREFERRED EMBODIMENTS

The invention will be better understood from the following detailed description of these various embodiments, including a description of the various non-linear dielectric materials employed: it will be obvious that these examples are of a non-limiting nature and in particular that the non-linear dielectric materials described can be applied without distinction to the various embodiments, and additionally that the non-linear dielectric material can be compact or in the form of thermoplastic or thermohardening composite materials. The examples chosen are typical; it will also be obvious that the principles employed may be applied to any other free or guided wave propagation structure.

FIG. 4 shows a typical coaxial cable embodying the invention with a center conductor 1 made from a conductive material (metal or alloy) that is solid, stranded or in layers. This conductor may be covered with a thin conductive layer chemically compatible with the non-linear dielectric material layer 2. This layer requires a direct contact of good quality to avoid the introduction of spurious conduction effects (affecting G).

For the same reasons, the outer conductor 4 must be compatible with and ensure a good contact with the dielectic material 2. As shown in the figure, a layer 3 may be provided to this end consisting, for example, of a metal deposit on the dielectric 2 (silver-plating, indium deposit, conductive polymer, wound-on thin metal film, colaminate, etc).

The layer 4 may be a conventional metal braid, a bundle of conductive wires, a metal tube, etc adapted for making the electrical connection. The layer 5 provides mechanical protection of the line or cable element such as a layer of plastics material, polymer, armour, etc. It may also or instead be a more or less conductive and or more or less absorbent dielectric layer (as described in French patent application No. 78 33385) or be implemented using the same type of non-linear dielectric material as the layer 2, to suppress external common mode currents/voltage surges.

In a first example the material 2 is a flexible non-linear dielectric material obtained by known means as described in the documents referred to in the preamble hereto.

For example, a mixture of a powder of sintered SiC of high conductivity because of type n or type p doping (carborundum NORTON 254 type) ground to a grain size (multicrystalized aggregates, comprising multiple active interfaces) in the range 30 through 200 microns and possibly screened on the basis of particle size is integrated by mixing into a flexible matrix material such as a plastics material (PVC, etc) or a polymer material (silicone, EPDM, etc) with a concentration of SiC by volume between 15% and 75%, equivalent to a concentration by weight of between 20% and 94%, depending on the density of the matrix material.

The choice of the precise powder (doping) and its concentration in the mixture are directly related to the normal operating voltages for a given thickness of the dielectric material (voltages for which the dielectric material is essentially an insulator) and to the voltages which are regarded as a "voltage surge" in the use of the cable (for which the dielectric material will be essentially conductive by virtue of the tunneling and/or Schottky effect (two reverse polarized diodes) "short-circuiting" the potential barrier due to the insulating interface. The mixture is then extruded/injection molded and where appropriate cross-linked around the center conductor.

There follows a numerical example for a mixture providing a coefficient of non-linearity of 3 to 4, covering three to four current decades. A charge of 73% by weight of doped SiC with a regular distribution of particle sizes between 50 and 150 microns is extruded with an outside diameter of 5 mm around a 2 mm diameter center conductor, after which the outer electrode is fitted. For this implementation and a cable length of 1 m, for a voltage U of 100 V the shunt current is 0.72 $\mu$A, increasing to 2.68 mA for a voltage U of 1 000 V. This corresponds to an average coefficient of non-linearity of 3.57.

In the present context, the dielectric material of the cable is considered to be essentially insulative at the voltage of 100 V while at 1 000 V (the surge voltage) the dielectric material is essentially a conductor.

The relative permitivity $\epsilon$ of this dielectric material (at low voltage) is 12.2 (at 100 Hz) and decreases slightly as the frequency increases: $\epsilon=11.0$ at 1 MHz and 9.1 at 100 MHz. Its dielectric loss angle (at low voltage) is $tg\delta_e=0.030$ (at 1 kHz), 0.015 (at 10 kHz) increasing to a maximum of approximately 0.021 (at 100 kHz) and then falling to 0.011 (at 100 MHz), typical variations for a composite material with intergranular phases.

As the voltage increases the permitivity and the dielectric losses increase. Thus the dielectric constant and the loss angle $tg\delta_e$ (due to r(U)) are increased more than tenfold, the dielectric losses equivalent to non-linear conduction (due to g(U)) obviously increasing much more quickly.

These unexpected effects, which are characteristic of the invention, will be discussed in more detail hereinafter.

One characteristic feature of the invention is to distribute the Joule effect in the case of high-level voltage surges of long duration: because of this, much higher power levels can be tolerated, as compared with conventional SiC and ZnO protective components. Specific effects may arise in the case of composite dielectric materials in acccordance with the invention.

Thus the power dissipated (by the Joule effect) in a dielectric material of this kind raises significantly the temperature of the non-linear composite material with the result that the material tends to expand and the area of contact between its particles tends to reduce, leading to an increase in the resistance with a positive temperature coefficient (PTC). In the case of a long-duration voltage surge, this effect leads to self-limiting of the current, that is to say automatic protection, although this is obviously to the detriment of the voltage surge suppression effect.

It is also obvious that if the mechanical implementation of the non-linear composite material matrix does not allow such expansion (for example if the outer jacket 4, 5 is very stiff, the non-linear dielectric material is highly compacted or the composite material uses a thermo-hardenable matrix) the PTC effect cannot come into play and it may even happen that a negative temperature coefficient (NTC) may arise because of increased pressure on the particles in the matrix (the same effect results from pressure due to other causes).

The application of an overvoltage to a propagation element of this type will evidently cause all of the voltage surge to appear at the input of the structure, the amplitude of the waveform (and the dissipation) decreasing as propagation proceeds. To provide a better distribution of the charge and of the dielectric stress the thickness of the non-linear dielectric material may be increased towards the ends of the line, or a less conductive non-linear composite material applied at the ends.

In a second example, applying to a structure analogous to that of FIG. 4, use is made of a non-linear dielectric material based on zinc oxide crystal agglomerate as used in the electronic protection devices known as varistors (MOVs). The agglomerate is obtained by breaking up sintered pieces, for example, and placed in a matrix material as described hereinabove, with a charge of at least 30% by weight of the agglomerate with at least half the grains having dimensions larger than 100 microns. A small charge (a few percent) of conductive graphite is added to increase the number of contacts between the agglomerates.

The coefficient of non-linearity obtained is approximately 5.1 with the conductivity (coefficient k) increased by an order of magnitude.

These two examples make it possible to generalize with regard to the basic constituent, that is to say the agglomerates of conductive crystals separated by interstices that are not conducting or only poor conductors (between conductive crystals), giving rise to the non-linear effects.

Numerous polycrystaline structures other than those mentioned can be used and have been described in the scientific and technical literature: mention made be made of other oxides such as those of alumina, magnesia, titanium and bismuth and other carbides such as those of titanium, bismuth, boron, etc, titanates of barium (as used in thermistors), sulfides such as zinc sulfide (as used in electroluminescent panels), thermo-electric compounds (as used in barrier layer capacitors), polycrystaline silcon, etc. Such structures can also be synthesized, as will be described later.

A further example is suited to currents an order of magnitude higher (that is to say, to even lower operating voltages), with a non-linear dielectric material agglomerates of crystals of SiC and titanium carbide, with added extremely fine conductive particles to improve the contact between agglomerates.

This composite material is available commercially under the name CHOTRAP from the company Chomerics, as already mentioned. With it coefficients of non-linearity n in the order of 7 can be achieved.

The relative permittivity of this composite material is approximately 15 at 100 Hz decreasing to 13 at 1 MHz with a low test voltage.

The current for 1 m of the cable described is 3.7 A for a maximum voltage U of 120 V (substantially conductive condition). At the normal operating voltage of 24 V the current is 47 $\mu$A (insulative condition).

Under voltage surge conditions the dielectric constant is multiplied by a factor between 50 and 100, and the same goes for the intrinsic dielectric losses (not due to conduction).

Because of the very considerable variation in the distributed capacitance of the structure, the propagation characteristic is completely changed, which is another aspect of the invention. A line which is normally well matched (with a low applied voltage) becomes strongly mismatched and most of the signal corresponding to the voltage surge is reflected at the input, a third effect which contributes to the protection against voltage surges. Immediate applications of these phenonema can be envisaged, by analogy with the TR and ATR cells used in radar.

The very significant increase in the dielectric losses in the event of a voltage surge increases the dielectric absorption, a fourth protective effect.

Finally, the following protection/absorption effects arise in accordance with the invention in the case of a voltage surge:

a resistive shunt (substantially conductive dielectric);

a significant increase in the dielectric loss angle (absorbing the electromagnetic wave);

a significant multiplication of the distributed capacitance (accumulating energy as charge);

mismatching of the four-pole device (if it was previously matched).

By way of a fourth example, there will be described a non-linear dielectric material which also has magnetic characteristics, together with some typical examples of the composition of a composite material of this kind, reflecting one of the important characteristics of the invention.

Because of operation at high frequencies the material has to be traversed by the electromagnetic fields, in other words its skin effect must be reduced: this condition imposes the use of fine ferromagnetic powders or ferrimagnetic materials.

To obtain high absorption at HF frequencies ferrites are a good choice, giving high permeability, reduced conduction (in the compacted state) and various other criteria as described in detail in French patent application No. 78 33385. Consisting of crystals that are poor conductors (basic characteristic of ferrite products), they comprise crystaline interstices with relatively conductive phases: in order words, conventional ferrites are not suitable for producing non-linear effects.

However, it is possible to produce ad hoc ferrites in which the interstices are optimized for the application in accordance with the invention: to this end it is first necessary to introduce some degree of conductivity into the crystals themselves, so as to be able to achieve good conduction with a high electric field (the tunneling and/or Schottky effect eliminating the effect of the insulative interstices). It is then necessary to introduce small additions of metals or metal salts which are not integrated into the magnetic structure of the crystals (or domains) but which are segregated in the form of compounds that have no or low conduction in the interstices between crystals. This produces depletion layers analogous to those of non-linear SiC and ZnO through the formation of depleted intergranular phases, with the salts of these additives only, or in combination of ferrites with metal salt components (Fe, Mn, Zn, Ni, Mg, etc).

A second technique in accordance with the invention is to obtain such interstices after the event (after the ferrite is sintered) by ad hoc processing of the ferrite, which is powdered. The application of such thin and substantially insulative layers in the form of a deposit in a primary adhesion solution, photo-polymerization in the polymer vapor phase, chemical processing of the grains, including oxidation in air, etc is a known processing technique in the chemicals industry.

An "artificial ferrite" of the first type combining magnetic effects and high HF absorption with non-linear conduction effects has been produced in accordance with the invention. It is of the Mn-Zn type (see cited patent) with the general formula: $Fe_2O_3$ ($MnO_x$ $ZnO_y$)+(SnO, $Ti0_2$, CaO, $Bi_2O_3$, CuO, etc.)$_z$ in which z corresponds to typical impurities (from 0 up to a few percent) intended to favor the formation of depleted intergranular phases containing these oxides (and others, such as salts of Sb, Pr, Ba, Sr, Nd, Rb, Zr, Co, etc) and more complex phases containing also the basic constituents of the ferrite (such as ZnO for example). Generally speaking these additives, highly basic conductive oxide compounds, together with insulative acid oxides favor the formation of interstitial layers that are non-conductive or poor conductors and the known factors conditioning the size of the ferrite crystals (such as CaO, for example) make it possible to define the number of Schottky junctions, that is to say the voltage at which the non-linear effects occur. In this general formula, x corresponds to the quantity of MnO, typically in the range from 20 to 50 mol % and y to the quantity of ZnO in the range from 0 through 40 mol %. The sum of the percentages x+y+z may be different from unity in that the composition of the ferrite is not stoichiometric, in particular to meet the condition for good conductivity of the grains. The excess of iron (appearing in the two valencies) is also a factor which favors the non-linear phenonema.

A typical artificial ferrite of this kind used as an example hererinafter contains 40 mol % MnO and 14 mol % ZnO (respectively 25% and 10% by weight) with 2 mol % $TiO_2$ and 0.6 mol % Co as additives to form the depleted interstitial layers. The ferrite makes it possible to obtain a high permeability, with high magnetic losses, for use as an HF absorbant; its dielectric losses show a maximum in the HF range, characteristic of the Maxwell-Wagner effect, due to a conductive phase and a quasi-insulative phase.

This ferrite may be used in a compacted form or as a composite material in accordance with the invention. To give an example of this latter application, with a composite material made from 85% by weight of ferrite (ground, with a linear distribution of agglomerate particle sizes between 50 and 200 microns) and 15% by weight of polyvinyl chloride (PVC), the conductivity obtained is near that for the example described using the SiC composite material with a coefficient of non-linearity n of 4 to 4.5 for four current decades.

An electric cables with the dimensions indicated and 1 m long gives a shunt current of 0.6 mA at 200 V (substantially insulative conditions) and 0.45 A at 1 000 V (substantially conductive condition).

An "artificial ferrite" of the second type uses, for example a conventional type Mn-Zn ferrite powder (with no special interface layer). This powder is surface treated in an aqueous or alcohol solution of silane (such as, for example, vinyl-tri (beta-methoxy-ethoxy-silane) or "A-172") and then hot dried at 150 degrees for two hours. The resulting material is then compacted in the press or molded to be integrated into a plastics or polymer matrix (composite material).

As already mentioned, the number of active interstices (depleted areas) determines the overall voltage drop (for a given thickness of non-linear material) and the use of larger and more conductive grains makes it possible to increase the non-linear current for a given electric field.

A commercially available product, TDK's H7C4 ferrite using additions of $SiO_2$ and CaO in the interstices with the appropriate thermal treatment (in a controled atmosphere) to obtain large crystals may be used to increase the conductivity by an order of magnitude as compared with the example above.

The conductivity of mixtures using these types of ferrite (large crystals, conductive crystals, etc) may be further increased with additions of agglomerates of SiC and/or ZnO with large grains and fine metal additions, possibly thermomagnetic (carbonyl iron, co-precipitated iron-nickel alloys, etc).

Such "artificial ferrites" (compacted or in composite material form) may be used to obtain in addition to the four effects already described:

a magnetic characteristic (increasing L by increasing the external self-inductance);

magnetic losses making it possible to implement absorbent propagation structures.

Magnetic structures featuring non-linear conductivity of this kind are particularly suited to suppression of parasitics by peak limiting (in the time domain) and by HF absorption (in the frequency domain): they represent an ideal solution to the problems of interference protection and EMC immunisation where high voltage surges may occur (EMP, lightning strikes, breaking of inductive circuits in automobiles), with very fast wavefronts (NEMP), and possibly with very short duration transients (Corona, automobile ignition interference, electrostatic discharge).

FIG. 5 shows one of many electric cable embodiments that can be produced using the principles as described with reference to FIG. 4. This is a multi-conductor cable (typically a low-voltage electrical power distribution cable) with two phase conductors and one ground conductor or with three phase conductors.

The reference numbers have the same meaning as for FIG. 4: the non-linear dielectric 2 is of double thickness between phases, so that the voltage (between phases) is doubled, as compared to the single thickness relative to ground previously. The metal/metalized layer 3 defines the electric field which determines the non-linear current due to differential voltage surges. Once again, common mode protection may be provided by the outer jacket 5.

FIG. 6 shows a flat line such as might be used in flat cables, hybrid circuits, propagation structures on printed circuits or surface-mount devices (SMD).

The conductors 1 and 3 define the electrodes of the line; the non-linear dielectric material 2 may be any of the compacted or composite materials in accordance with the invention.

It will be obvious that the principles of the invention are applicable to other structures not described in detail, such as guided and unguided wave propagation structures, those utilizing meandering or helical conductors, etc.

In this connection two further examples will be described with reference to the figures.

FIG. 7 shows an insulated cable with a center conductor 1, an "insulative" dielectric material 2 and localized grounds at 3′ and 3″.

The field gradient for the ground at 3′ may be high, due to the effect of the point at 7: this point constitutes a weakened location where breakdown of the dielectric material 2 (normal insulation) is more likely to occur.

In accordance with the invention, the dielectric material 2 is entirely (or partially in the radial direction of the cable) constituted by a non-linear dielectric material: any localized high field gradient will give rise to low conduction and consequent spreading of the field lines, avoiding breakdown.

A typical application corresponds to the ignition cables of automobile engines. In this case, the conductor 1 may be straight (consisting of a conductive or resistive metal or a more or less conductive composite material, such as a carbon-based composite material) or it may consist of a helix around a non-magnetic or absorbant magnetic core, as described in French patent applications Nos. 78 33385 and 86 00617.

The thickness of the dielectric material 2 (conventional insulation) is limited in practise, because of applicable standards, for example, or for reasons of cost. The point at which the insulation is weakened is situation at the location 7 where the ignition cable is near to or touches a metal part, such as a part of the engine or the accelerator cable, for example; implementation in accordance with the invention makes it possible to reduce the safety margin of the insulation.

Likewise, for an extremely thin conductor 1 (straight or in a helix) the point effect specific to the conductor may be "spread" by means of a non-linear dielectric material in accordance with the invention. For example, a conventional and commercially available absorbent ignition lead utilises a 2.5 mm diameter helix made from metal wire with a diameter of 0.10 mm, wound at approximately 30 turns per centimeter. The internal electrical stress is reduced by providing an inner layer of non-linear dielectric material, or by using only the non-linear dielectric material.

Such ignition cables comprise at their ends electrical connections (attached to the wire 1), with insulating covers 6 of rubber or a plastics or polymer material to protect the connection to the sparkplug or to the distributor.

The same phenonema occur in the presence of a localized ground 3′, accentuated by the fact that the termination 6 may, with the insulation 2, define a thin air gap causing an additional high potential gradient favoring breakdown of the insulation. In the latter case, with all or part of the termination 6 made from the non-linear dielectric in accordance with the invention, protection against breakdown can be provided without requiring high-performance insulating materials or difficult implementation/assembly processes.

These latter examples demonstrate what is obvious, namely that the non-linear function may be combined with the magnetic absorption effect (by using a non-linear magnetic compound/composite material), adding an absorbent lowpass filter effect to the structure. A typical combination involves using a central core (for the helix) made from a magnetic non-linear dielectric material (protecting the thin wire of the helix from the gradient) and an outer "insulative" layer using one of the non-linear composite materials described that is a poor conductor (magnetic or non-magnetic) suitable for the high voltages involved.

FIG. 8 shows the possibility of combining such protection against discontinuities (with their localized high potential gradients) with an absorption lowpass filter effect: in this case also only part of the cable is covered with the absorbent magnetic non-linear dielectric material, the case corresponding to the schematic in FIG. 2.

In the lefthand part of FIG. 8 the non-linear magnetic dielectric material 2″ is superposed concentrically on a conventional dielectric material 2′. In this "coaxial" part the lowpass absorbent effect is combined with the non-linear effect but it is also obvious that the non-linear effect can only occur for variations in the voltage-overvoltage (FIG. 3 schematic).

In the righthand part of FIG. 8 the magnetic non-linear dielectric material 2" serves as a conventional "equipotential sleeve" (see the reference documents cited in the preamble) and would cover the stripped part (of the connection) with a configuration therefore analogous to that of the previous example. Also as previously, the magnetic non-linear dielectric material may constitute all of the cross-section of the dielectric material, which implementation corresponds to the schematic in FIG. 1.

FIG. 9 shows the application of the principles of the invention to a free wave propagation structure.

A plane electromagnetic wave is incident on the metallic surface 3 of a mechanical structure such as an aircraft, boat, etc, this wave originating from a radar beam, for example, and the surface 4 being an object to be sensed or a beacon.

Known RAM (radar absorbing material) techniques entail applying to the surface of the object 3 an absorbent dielectric layer 2 the characteristics of which are selected for optimum absorption of the wave (as it passes through the layer 2) and minimum direct reflection of the wave. Such dielectric layers are known and generally utilize absorbent magnetic materials.

In accordance with the invention, the dielectric layer 2 is made in whole or in part from non-linear absorbent magnetic material with an ad hoc characteristic impedance.

With sufficient incident power or by virtue of application of a voltage (by means of an electrode 9 which is transparent to the wave) the reflectivity of the structure may be modified between total absorption (making the object invisible to the radar, with the minimum RCS) and quasi-total reflection (maximum RCS) analogous to the mismatch effects in the case of cables as described hereinabove.

Finally, FIG. 10 shows another application of the invention to a component for electronic circuits in which the concentration of capacitative, absorption and non-linear effects produces beneficial and practical filter components.

In this figure, the conductor 1 may be made with solder terminal connections at the ends of a lead-through hot conductor. It may also be formed by metal plating the inside of a passage in the dielectric 2 for a wire, a connecting plug, etc to be passed through.

The dielectric material 2 is a magnetic absorbent non-linear material as described above ("artificial ferrite"). This procures the absorption lowpass filter effect with protection by shunt conduction in the presence of a voltage surge. Optional metal plating 3 serves to make contact with the ground electrode 4 forming the four-pole/three-pole structure.

Components of this kind with no capacitive filter or lowpass absorber filter effect have been described in recent literature, fabricated from compacted ZnO (10th International Aerospace and Ground Conference on Lightning and Static Electricity; Wolff and Earle: "A new form of transient suppressor", p. 293ff).

The component in accordance with the invention may obviously be made in a multiple form, that is to say in which parallel conductors 1 form a filter-connector or metal-plated holes 1 as described form a filter-socket for integrated circuits, connectors, etc, the connections of which then pass through the filter-socket.

There is claimed:

1. Structure adapted to propagate an electromagnetic wave, comprising: at least one conductive member, and an adjacent dielectric material distributed in a wave propagation direction, through which said wave passes, said dielectric material exhibiting non-linear conductivity such that it is substantially non-conductive at a rated applied voltage of the structure, and substantially conductive at any abnormally high applied voltage, said distributed dielectric material comprising a granular, conductive polycrystaline material having thin interstitial, substantially insulating layers disposed between grains of said polycrystaline material.

2. Structure according to claim 1, wherein said polycrystaline material is a non-magnetic solid.

3. Structure according to claim 2, wherein said polycrystaline material is chosen from the group comprising crystaline silicon, zinc oxide, aluminum oxide, magnesium oxide, titanium oxide and bismuth oxide, silicon carbide, titanium carbide and boron carbide, barium titanate and strontium titanate, ferro-electric compounds, polyethylene-mica compounds and zinc sulfide, and substantially conductive powder materials surface treated to produce said substantially insulative layers.

4. Structure according to claim 1, wherein said polycrystaline material comprises grains of a multicrystaline aggregate in a low conductivity matrix with sufficient concentration to procure at least partial contact between said grains.

5. Structure according to claim 1, wherein said dielectric material has a dielectric constant and a dielectric loss angle proportional to the applied voltage, whereby it has a distributed capacitance and features increasing dielectric absorbtion.

6. Structure according to claim 5, wherein any abnormally high applied voltage propagating through the structure is partially eliminated by conduction to ground, partially stored and absorbed by virtue of an increase in the capacitance to ground and an increase in dielectric losses, and partially reflected towards its source as a result of mismatching of the structure due to its increased distributed capacitance.

7. Structure according to claim 1, wherein said dielectric material is a polycrystaline solid comprising agglomerates of relatively conductive magnetic crystals and substantially insulative thin intergranular layers.

8. Structure according to claim 7, wherein said magnetic polycrystaline material is in the form of grains of a multicrystaline aggregate in a low conductivity matrix material with sufficient concentration to procure at least partial contact between said grains.

9. Structure according to claim 7, wherein said dielectric material has a dielectric constant and a dielectric loss angle proportional to the applied voltage, whereby it has a distributed capacitance and increasing dielectric absorbtion, and a magnetic permeability and a magnetic loss angle that are voltage-independent and proportional to the frequency of the applied voltage.

10. Structure according to claim 7, wherein any abnormally high applied voltage propagating through the structure is partially eliminated by conduction to ground, partially stored and absorbed by virtue of an increase in the capacitance to ground and an increase in dielectric losses, partially reflected towards its source as a result of mismatching of the structure due to its increased distributed capacitance, and partially absorbed by virtue of magnetic permeability and magnetic losses.

11. Structure according to claim 7, wherein said intergranular layers comprise a ferrimagnetic ceramic material incorporating specific impurities favoring creation of said intergranular layers, with substantially insulative phases and optional low concentration additives to optimize the non-linearity.

12. Structure according to claim 7, wherein said intergranular layers comprise a substantially conductive ferrimagnetic powder surface treated to produce said substantially insulative layers.

13. Structure according to claim 1, wherein wave propagation is protected by simultaneous elimination of parasitics exceeding a specific amplitude threshold and transients exceeding a specific frequency irrespective of their amplitude.

14. Structure according to claim 1, wherein said dielectric material has a non-linear coefficient of two or more.

15. Structure according to claim 1, wherein said dielectric material is interleaved with at least one insulative layer.

16. Structure according to claim 1, implemented as an electrical cable or line or as a component of an electrical cable or line comprising at least two conductors or at least one conductor and one ground.

17. Structure according to claim 16, implemented as an electrical cable or line or as a component of an electrical cable or line comprising at least two conductors or at least one conductor and one ground and wherein said cable or line or component comprises a conventional inner insulator and said dielectric material on the outside, a specific length of said dielectric material serving as a sleeve for distributing the field gradient at the terminations of the structure.

18. Structure according to claim 1, adapted to propagate a free wave or a guided wave and wherein said non-linearity is selectively implemented.

19. Structure according to claim 1, implemented as an insulated ignition lead for internal combustion engines comprising insulative end caps and wherein at least some of the insulation of said cable and/or said insulative end caps is provided by said dielectric material, whereby dielectric stresses are reduced at any point in contact with or near grounded points and between turns of the cable if coiled.

20. Structure according to claim 1, implemented as a three-pole or four-pole inductive or capacitive protection device, for use in more complex filters.

21. Structure according to claim 1, implemented as a system including at least one inductor and capacitor of which at least one is a three-pole or four-pole device, for use in more complex filters.

22. Structure according to claim 1, wherein expansion of said dielectric material due to the thermal effects of an excessively high applied voltage is controled to procure selectively a temperature coefficent that is positive or null or negative.

* * * * *